US005509483A

United States Patent [19]

Graen

[11] Patent Number: 5,509,483

[45] Date of Patent: Apr. 23, 1996

[54] METHOD AND APPARATUS FOR ANCHORING A WELL SCREEN ON A PERFORATED MANDREL OF STAINLESS STEEL

[75] Inventor: Lawrence J. Graen, Kingwood, Tex.

[73] Assignee: Houston Well Screen Company, Houston, Tex.

[21] Appl. No.: 347,796

[22] Filed: Dec. 1, 1994

[51] Int. Cl.[6] ..... E21B 43/08

[52] U.S. Cl. ..... 166/382; 166/51; 166/227

[58] Field of Search ..... 166/51, 278, 378, 166/382, 157, 227, 228, 229, 232, 235, 236

[56] References Cited

U.S. PATENT DOCUMENTS

| | | | |
|---|---|---|---|
| 1,356,187 | 10/1920 | Burgard | 166/228 |
| 2,523,091 | 6/1945 | Bruce | 166/228 |
| 2,525,897 | 10/1950 | Greene | 166/228 |
| 3,385,373 | 5/1968 | Brown | 166/232 |
| 3,450,207 | 6/1969 | Hirsch | 166/236 |
| 4,526,230 | 7/1985 | Kojicic | 166/51 X |
| 4,750,557 | 6/1988 | Gauranovic | 166/51 |
| 5,394,938 | 3/1995 | Cornette et al. | 166/51 |

*Primary Examiner*—Frank S. Tsay
*Attorney, Agent, or Firm*—Vaden, Eickenroht, Thompson & Feather

[57] ABSTRACT

A method and apparatus is described for anchoring a well screen on a stainless steel perforated mandrel without the use of welds in which cup-shaped members, each having a base and an annular wall, are positioned on the mandrel at each end of the screen with the walls of the cups extending partly over the screen and filling the annular cavities between the walls of the cups and the ends of the screen with a liquid adhesive epoxy to anchor the cups to the mandrel.

7 Claims, 1 Drawing Sheet

METHOD AND APPARATUS FOR ANCHORING A WELL SCREEN ON A PERFORATED MANDREL OF STAINLESS STEEL

This invention relates to a method of and apparatus for anchoring a well screen on a perforated stainless steel mandrel to hold the screen against longitudinal movement relative to the mandrel without welding the screen to the mandrel.

Because of the highly corrosive nature of some of the fluids produced in oil and gas wells today, there is a need to provide well screens made of corrosive resistant material, such as stainless steel. It is not so important that the screen itself be made out of corrosive resistant material but it is important that the mandrel which supports the screen and which is going to be subjected to the stresses of moving the pipe in and out of the well bore, be made of highly corrosive resistant material. Therefore, it is desirable to have mandrels made of high chrome stainless steel. The trouble is that this material, because of the high chrome content, is adversely affected by the heat required to the screen to the mandrel weld. Specifically, the heat of the weld will cause the high chrome stainless steel at the weld to become hard and brittle greatly reducing its tensile strength and creating an extremely weak link in the pipe string.

In an effort to overcome this problem, screens have been clamped to the outside of stainless steel mandrels using bolts. This arrangement has proven unsatisfactory because of the clamps offer limited resistance to the movement of the screens relative to the mandrel. Clamps are particularly unsatisfactory for use on screens that are to be located in horizontal portions of a well bore where the screens drag along the low side of the hole as the screen is moved into position in the well bore.

Consequently, it is an object and feature of this invention to provide apparatus for and a method of attaching a well screen to a stainless steel mandrel that does not require a weld.

It is a further object and feature of this invention to provide such apparatus and method that will attach the screen to the mandrel so securely that the sleeve will not move longitudinally on the mandrel even though the screen is pushed into a horizontal hole with the screen dragging on the low side of the hole.

It is a further object and feature of this invention to provide apparatus and method of attaching a well screen to a stainless steel perforated mandrel that employs an adhesive epoxy to anchor the screen to the outside of the perforated stainless steel mandrel.

It is yet another feature and object of this invention to provide an apparatus and method for mounting a well screen on a perforated mandrel that will hold the screen against longitudinal movement relative to the mandrel and also support an outer second screen that encircles the first screen and provides an annulus for a gravel pack between the two screens.

These and other objects, advantages, and features of this invention will be apparent to those skilled in the art from a consideration of the specification including the attached drawings and appended claims.

IN THE DRAWINGS

Figure 1:
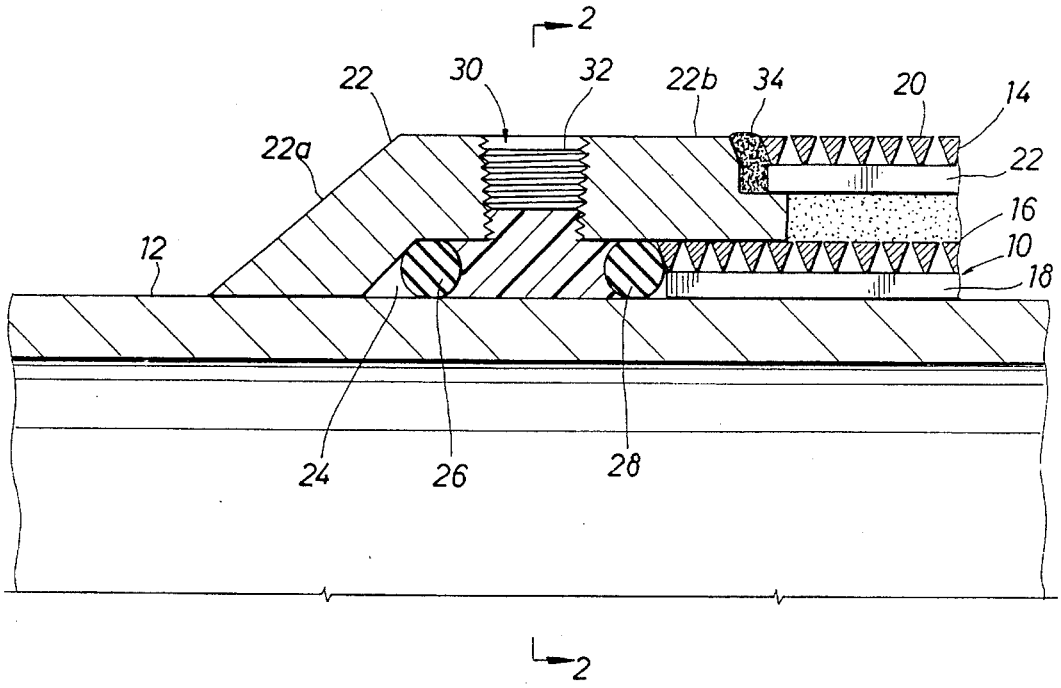
FIG. 1 is a sectional view taken through a stainless steel mandrel with two spaced concentric screens mounted thereon using the apparatus and method of this invention.
Figure 2:
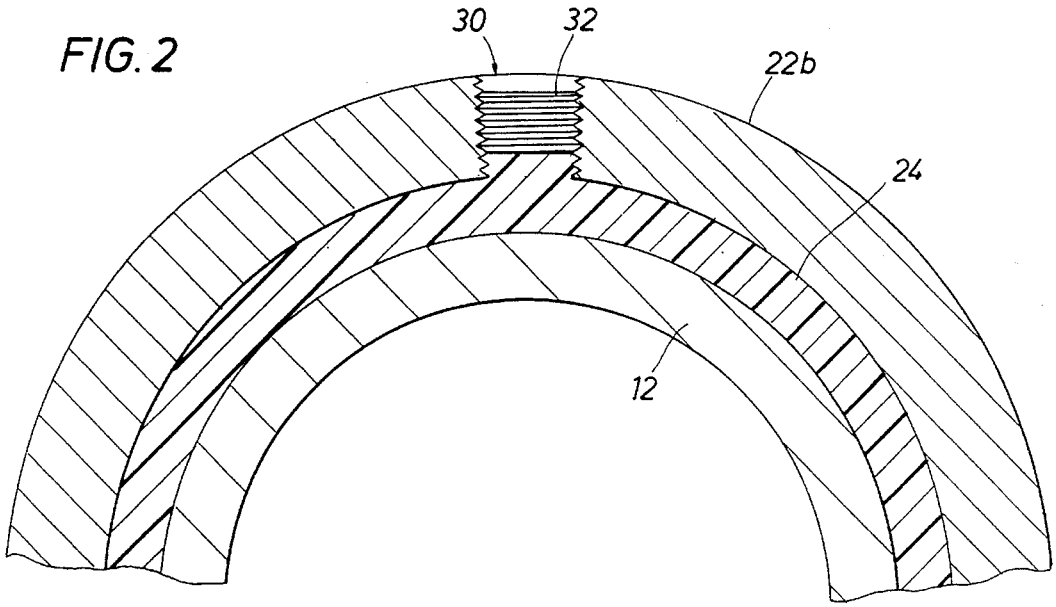
FIG. 2 is a section taken along line 2—2 of FIG. 1.

Both screen 10 that engages the outer surface of stainless steel mandrel 12 and screen 14 are rod based well screens. Screen 10 is a rod based well screen that is formed in place on the outer surface of perforated pipe base or mandrel 12, which is made out of high chrome stainless steel, by wrapping wire 16 around and extending longitudinally along pipe base 12 and a plurality of spaced rods 18 spaced around the outside of the mandrel. The wire is welded sequentially to each individual rod as it is wrapped around the pipe. The method and apparatus for forming a well screen directly on the outer wall of a mandrel is described in U.S. Pat. No. 4,314,129 entitled "Method and Apparatus for Making Well Screen" that is assigned to the assignee of this invention. U.S. Pat. No. 4,314,129 is incorporated herein by reference in its entirety.

Screen 14 is also made up of wire 20 that is wrapped around longitudinally extending spaced rods 22.

Both ends of the screens are anchored in place on the outside surface of mandrel 12 in the same manner, only one end as shown in the drawings and will be described below.

In FIG. 1, cup-shaped member 22 having base **22*a* and wall portion 22*b* is positioned on mandrel 12 with the base 22*a* in contact with the mandrel and wall 22*a* spaced from the mandrel to form annulus 24 between the wall of the cup and mandrel 12. Wall 22*b* of the cup extends over screen 10, a short distance, as shown in FIG. 1. Seal rings 26 and 28 are positioned in annulus 24 on opposite sides of threaded opening 30, which is shown closed by threaded cap screw 32. Before opening 30 is closed, however, liquid epoxy is poured into annulus 24 through opening 30 to fill the annulus between mandrel 12 and wall 22*b* of the cup-shaped member 22. Tapped opening 30 is then closed with cap screw 32, which preferably exerts sufficient pressure on the liquid epoxy in annulus 24 to increase the pressure in the annulus to about 15 psi. The epoxy is then cured by applying heat using an induction coil. The amount of heat and the time it is applied will depend upon the epoxy. In the preferred embodiment, epoxy number EA9432NA manufactured by Dexter, located at One Dexter Drive, Seabrook, N.H. 03874, and sold under the trademark HYSOL has been found to be very satisfactory. It can be cured in 60 minutes at 250° F. or 30 minutes at 300° F. Cure temperatures above 350° F. are not recommended. This epoxy will bond to the inside of cup 22 and the outer surface of mandrel 12 and hold cup 22 from moving axially relative to the mandrel, thereby anchoring both screens 16 and 20 against longitudinal movement relative to the mandrel. Screen 14 is anchored to cup 22 by weld 34**.

This connection has been tested to determine how much force would be required to move a screen so mounted on a stainless steel mandrel. The mandrel was 6.625" in diameter. Two screens were anchored to the outside of the mandrel in the manner described above. The outside diameter of the finished assembly was 7.375" at the outer wall of the cup. A force of 92,500 lbs. was required to move the screens relative to the mandrel. The test was run on Sep. 27, 1994 by Huntingdon-Southwestern Laboratories of Houston, Tex. The 92,500 lbs. is well beyond any force that would be exposed on the screen as it is dragged or pushed into or out of a horizontal wellbore while in contact with the low side of the hole.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A well screen assembly comprising a perforated mandrel of stainless steel, a first screen mounted on the mandrel, two cup shaped members, each having a base and an annular wall, positioned on the mandrel at opposite ends of the screen with a portion of the annular wall of each cup extending over the ends of the screen to provide annular cavities between the mandrel and the annular wall of the cup that extend from the end of the screen to the base of the cups, openings extending through the walls of the cups into the annular cavities, seal rings in the cavities on opposite sides of the openings and, a body of adhesive epoxy filling the cavity of each cup to attach the cups to the mandrel and hold the screen from longitudinal movement relative to the mandrel.

2. The well screen assembly of claim 1 further provided with a second well screen encircling the first well screen with each end welded to the cup.

3. The well screen assembly of claim 2 in which the second well screen is spaced from the first well screen to provide an annulus between the screen and a gravel pack is located in the annulus.

4. The well screen assembly of claim 3 in which the end of the wall of each cup has a lip portion that extends between the first and second screens to hold the screens spaced apart and concentric.

5. A method of anchoring a well screen on a perforated tubular mandrel to hold the well screen from longitudinal movement relative to the mandrel comprising the steps of positioning the well screen on the mandrel, locating cup-shaped members having a base and a cylindrical wall on the mandrel at opposite ends of the screen with the walls of the cup-shaped members extending partly over the ends of the screen to provide annular cavities between the walls of the cups and the mandrel, filling the annular space with liquid epoxy, and heating the epoxy the required amount to cure the epoxy and cause the epoxy to adhere to the walls of the cups and the mandrel to hold the cups and the screen from longitudinal movement relative to the mandrel.

6. The method of claim 5 further including the steps of positioning a second well screen over the well screen on the mandrel and welding the second well screen to the cup-shaped members.

7. The method of claim 5 or 6 in which the cup walls are provided with openings through which the annular cavities are filled with epoxy further including the step of positioning the mandrel with its longitudinal axis horizontal prior to filling the annular cavities with liquid epoxy, pouring the liquid epoxy into the annular cavities through openings in the cup wall at the top of the annular cavities until the epoxy fills the annular cavities and a portion of the tapped openings is full of liquid epoxy, and increasing the pressure in the epoxy prior to curing the epoxy with heat.

* * * * *